US010670025B2

(12) United States Patent
Yamashita

(10) Patent No.: US 10,670,025 B2
(45) Date of Patent: Jun. 2, 2020

(54) CENTRIFUGAL COMPRESSOR

(71) Applicant: MITSUBISHI HEAVY INDUSTRIES COMPRESSOR CORPORATION, Tokyo (JP)

(72) Inventor: Shuichi Yamashita, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 75 days.

(21) Appl. No.: 15/781,430

(22) PCT Filed: Aug. 4, 2016

(86) PCT No.: PCT/JP2016/072880
§ 371 (c)(1),
(2) Date: Jun. 4, 2018

(87) PCT Pub. No.: WO2017/094287
PCT Pub. Date: Jun. 8, 2017

(65) Prior Publication Data

US 2018/0347571 A1 Dec. 6, 2018

(30) Foreign Application Priority Data

Dec. 4, 2015 (JP) ..... 2015-237121

(51) Int. Cl.
*F04D 17/12* (2006.01)
*F04D 29/30* (2006.01)
(Continued)

(52) U.S. Cl.
CPC ..... *F04D 17/12* (2013.01); *F04D 17/122* (2013.01); *F04D 29/284* (2013.01);
(Continued)

(58) Field of Classification Search
CPC ..... F04D 17/12; F04D 17/122; F04D 29/286; F04D 29/284; F04D 29/242; F04D 29/30; F04D 27/0246
See application file for complete search history.

(56) References Cited

U.S. PATENT DOCUMENTS 5,228,832 A * 7/1993 Nishida ..... F04D 17/06 415/208.1
5,490,760 A * 2/1996 Kotzur ..... F01D 15/12 415/115
(Continued)

FOREIGN PATENT DOCUMENTS

JP H06-193585 A 7/1994
JP H10-184585 A 7/1998
(Continued)

OTHER PUBLICATIONS

International Search Report for corresponding International Application No. PCT/JP2016/072880, dated Oct. 18, 2016 (5 pages).
(Continued)

*Primary Examiner* — Ninh H. Nguyen
*Assistant Examiner* — Behnoush Haghighian
(74) *Attorney, Agent, or Firm* — Osha Liang LLP

(57) ABSTRACT

A centrifugal compressor, in which a plurality of impellers that rotate along with a rotation shaft to pump fluid by using centrifugal force are disposed at a plurality of stages along an axial direction to compress, in a stepwise manner, the fluid sucked in from a suction port, the centrifugal compressor including: a closed impeller including a plurality of vanes disposed in a radial manner about the rotation shaft, and a shroud covering the plurality of vanes from radially outside; and an open impeller including a second plurality of vanes without a shroud. The closed impeller is disposed at a rearmost stage in a fluid flow direction. The open impeller
(Continued)

is disposed at a stage located immediately after the suction port in the fluid flow direction.

1 Claim, 2 Drawing Sheets

(51) Int. Cl.
*F04D 29/28* (2006.01)
*F04D 29/44* (2006.01)

(52) U.S. Cl.
CPC ..... *F04D 29/286* (2013.01); *F04D 29/30* (2013.01); *F04D 29/444* (2013.01); *F05B 2240/301* (2013.01)

(56) References Cited

U.S. PATENT DOCUMENTS 6,162,015 A * 12/2000 Nagai ..... F04D 17/122 415/199.2
6,174,131 B1 1/2001 Janson
2008/0229742 A1* 9/2008 Renaud ..... F04D 29/284 60/597
2014/0369823 A1* 12/2014 Yamashita ..... F04D 29/284 415/203
2015/0152884 A1* 6/2015 Guenard ..... F04D 17/122 417/243
2015/0159670 A1 6/2015 Saito
2016/0327056 A1* 11/2016 Nakaniwa ..... F04D 27/0238
2018/0209427 A1* 7/2018 Iurisci ..... F25J 1/0022

FOREIGN PATENT DOCUMENTS

JP 2002-257080 A 9/2002
JP 2009-221984 A 10/2009
WO 2012/007465 A1 1/2012
WO WO-2013182492 A1 * 12/2013

OTHER PUBLICATIONS

International Preliminary Report on Patentability for corresponding International Application No. PCT/JP2016/072880, dated Jun. 5, 2018 (13 pages).

* cited by examiner

CENTRIFUGAL COMPRESSOR

TECHNICAL FIELD

The present invention relates to a centrifugal compressor in which an impeller that compresses a fluid by using a centrifugal force.

BACKGROUND

Centrifugal compressors pump a sucked fluid by using a centrifugal force on an impeller that rotates along with a rotation shaft. Among such centrifugal compressors, a single-shaft multi-stage centrifugal compressor has been well known in which a plurality of impellers are provided at a plurality of states along the axial direction to compress a fluid in a stepwise manner. By employing such a configuration, a high compression ratio can be easily obtained for the fluid.

Further, a conventional centrifugal compressor as described above is disclosed in Patent Document 1, for example.

PATENT DOCUMENT

Patent Document 1: Japanese Patent Application Publication No. 2002-257080

Here, an impeller includes a plurality of vanes arranged in the circumferential direction and is categorized as a closed impeller or an open impeller depending on the presence or absence of a shroud that covers these vanes from radially outside. Further, in the above conventional centrifugal compressor, all the impellers are open impellers.

On the other hand, in a case of employing a closed impeller, the impeller includes the shroud, which is a heavy object, and accordingly a large centrifugal force is applied to the impeller itself. To withstand such a large centrifugal force, it is necessary to improve the strength of the joints between the plurality of vanes and the shroud, but there is a limit in improving strength of the joints. Hence, for a centrifugal compressor including a plurality of closed impellers at a plurality of stages, it is necessary to set an upper limit for the number of revolutions in accordance with the strength of the closed impellers.

Also, as described above, a centrifugal compressor including a plurality of closed impellers at a plurality of stages cannot be operated at a relatively high number of revolutions. For this reason, the number of stages with closed impellers may need to be increased depending on the final compression ratio required for the fluid (the compression ratio at discharge). Increasing the number of stages with closed impellers as above may possibly increase the size of the centrifugal compressor and accordingly increase the installation space and the manufacturing cost.

SUMMARY

Thus, one or more embodiments of the present invention provide a centrifugal compressor capable of achieving an increased number of revolutions and a reduced size and cost.

One or more embodiments of a centrifugal compressor according to a first aspect of the invention is a centrifugal compressor in which a plurality of impellers that rotate along with a rotation shaft to pump a fluid by using a centrifugal force are provided at a plurality of stages along an axial direction to compress, in a stepwise manner, the fluid sucked in from a suction port, characterized in that the centrifugal compressor comprises:

a closed impeller including a plurality of vanes disposed in a radial manner about the rotation shaft, and a shroud covering the plurality of vanes from radially outside; and an open impeller including the plurality of vanes but not including the shroud, the closed impeller is disposed at least at a rearmost stage, and the open impeller is disposed at least at a stage located immediately after the suction port in a fluid flow direction.

One or more embodiments of a centrifugal compressor according to a second aspect of the invention is characterized in that rear edges of the vanes of the open impeller are inclined to be closer to an inner side in a radial direction as extending toward an axial rear end side.

One or more embodiments of a centrifugal compressor according to a third aspect of the invention is characterized in that the farther rearward the open impeller is disposed, the smaller an inclination angle of the rear edges becomes with respect to an axis of the rotation shaft.

Thus, the centrifugal compressor according to one or more embodiments of the present invention includes an open impeller including no shroud. Accordingly, it is possible to reduce the total impeller weight and increase the number of revolutions. Also, since the number of revolutions can be increased, the compression efficiency per impeller stage can be improved accordingly. Then, the total number of impeller stages can be reduced. Accordingly, it is possible to achieve a reduced size and cost.

DETAILED DESCRIPTION

Figure 1:
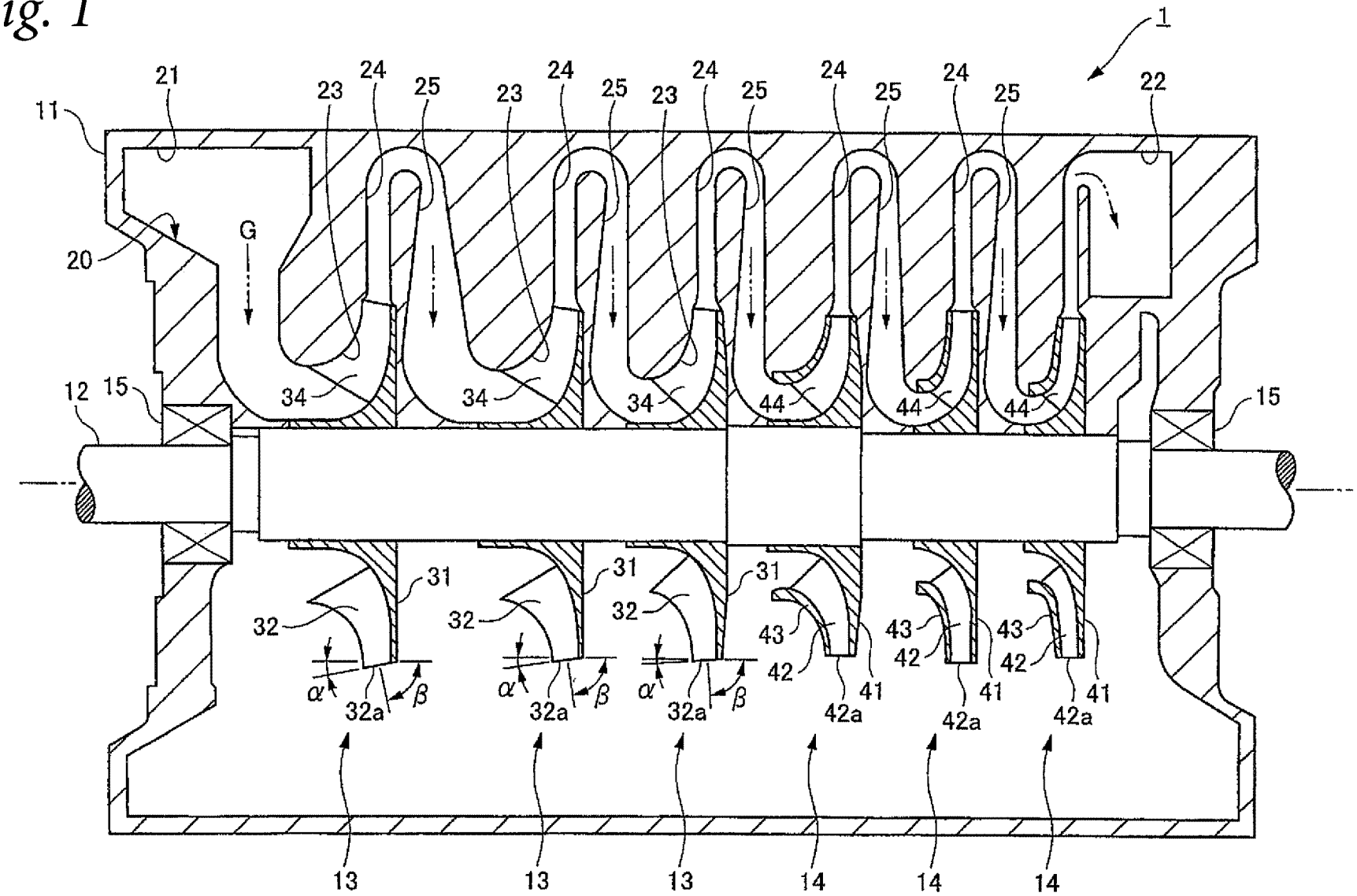
FIG. 1 is a schematic cross-sectional view of a centrifugal compressor according to one or more embodiments of the present invention.

Centrifugal compressors according to one or more embodiments of the present invention will be described below in detail with reference to the drawings. Note that the upper half of each of FIGS. 1 and 2 above a rotation shaft is a longitudinal cross section of an entire centrifugal compressor while the lower half below the rotation shaft is a longitudinal cross section of only impeller, and the arrows with dashed lines indicate the direction of flow of a fluid. Moreover, members in FIG. 2 corresponding to members illustrated in FIG. 1 are denoted by the same reference numerals as the reference numerals of those members illustrated in FIG. 1 and description thereof will be omitted.

As illustrated in FIG. 1 and in accordance with one or more embodiments, a centrifugal compressor 1 that pumps a fluid (air or gas) G mainly includes a casing 11 having a tubular shape, a rotation shaft 12 rotatably supported in this casing 11, and a plurality of impellers 13, 14 provided on this rotation shaft 12 at a plurality of stages along its axial direction. In other words, the centrifugal compressor 1 is a single-shaft multi-stage centrifugal compressor provided with a plurality of impellers 13, 14 on a single rotation shaft 12 at a plurality of stages and including a single inlet and a single outlet for the fluid G.

Note that in the centrifugal compressor 1 according to one or more embodiments of the present invention, the open impellers 13 are disposed on a front stage side (three stages on the front side), on which the volumetric flow rate of the fluid G is relatively high, while the closed impellers 14 are disposed on a rear stage side (three stages on the rear side), on which the volumetric flow rate of the fluid G is relatively low, for example.

Specifically, the rotation shaft 12 is supported through the center of the casing 11. Moreover, a bearing 15 is provided at each of the opposite axial ends of the casing 11, and these bearings 15 rotatably support the front end (one end) and the rear end (the other end) of the rotation shaft 12, respectively. In other words, the rotation shaft 12 is rotatably supported in the casing 11 through the bearings 15.

Also, a flow channel 20 is formed in the casing 11. This flow channel 20 causes the fluid G to flow from an axial front end side, i.e., a side closer to the suction port 21, toward an axial rear end side, i.e., a side closer to the discharge port. Further, a suction port 21 through which to suck in the fluid G from outside the compressor is formed on the axial front end side of the casing 11, while a discharge port 22 through which to discharge the fluid G to the outside of the compressor is formed on the axial rear end side of the casing 11. Specifically, the fluid G is raised in pressure in a stepwise manner as it flows from the suction port 21 to the discharge port 22. Details will be described later.

Further, the flow channel 20 not only functions as a flow channel in which the fluid G is caused to flow as described above but also functions as a housing space which houses the open impellers 13 and the closed impellers 14. Specifically, the flow channel 20 extends from the axial front end side to the axial rear end side while meandering radially to thereby allow the impellers to communicate with each other.

Here, each open impeller 13 includes a hub 31 and a plurality of vanes 32.

The hub 31 is formed in a circular ring shape with an outside diameter gradually increasing from the axial front end side (upstream side in the fluid flow direction) toward the axial rear end side (downstream side in the fluid flow direction). The rotation shaft 12 is fitted in its center hole.

Also, the vanes 32 are disposed on the outer peripheral surface of the hub 31 in a radial manner about the rotation shaft at equal intervals in the circumferential direction. Specifically, each vane 32 is formed to gradually curve outward in the radial direction as extending from the axial front end side toward the axial rear end side, and the tip of the vane 32 is formed along a wall surface 23 of the flow channel 20 that faces the tip in the radial direction. Note that the wall surface 23 is a smooth curved surface without steps. Moreover, a rear edge 32*a* of the vane 32 is formed to be inclined with respect to the axis of the rotation shaft 12. Specifically, the rear edge 32*a* is inclined to be closer to an inner side in the radial direction as extending from the axial front end side toward the axial rear end side.

Thus, at each open impeller 13, a plurality of spaces surrounded by the wall surface 23 of the flow channel 20, the outer peripheral surface of the hub 31, and the side surfaces of the vanes 32 are formed at equal intervals in the circumferential direction. In other words, these spaces serve as a compression flow channel 34 in which the fluid G taken in is compressed, and are disposed in a radial manner about the rotation shaft 12 and formed to gradually curve outward in the radial direction as extending from the axial front end side toward the axial rear end side. Moreover, the above-described rear end 32*a* of each vane 32 forms the outlet of the compression flow channel 34.

Thus, the open impeller 13 can eject the fluid G taken into the compression flow channel 34 outward in the radial direction from that outlet by using a centrifugal force generated by rotating along with the rotation shaft 12. Here, the fluid G taken into the open impeller 13 is raised in pressure as it passes through the compression flow channel 34.

On the other hand, each closed impeller 14 includes a hub 41, a plurality of vane 42, and a shroud 43.

The hub 41 is formed in a circular ring shape with an outside diameter gradually increasing from the axial front end side (upstream side in the fluid flow direction) toward the axial rear end side (downstream side in the fluid flow direction). The rotation shaft 12 is fitted in its center hole.

Also, the vanes 42 are disposed on the outer peripheral surface of the hub 41 in a radial manner about the rotation shaft 12 at equal intervals in the circumferential direction. Specifically, each vane 42 is formed to gradually curve outward in the radial direction as extending from the axial front end side toward the axial rear end side. Moreover, a rear edge 42*a* of the vane 42 extends in the axial direction, that is, the rear edge 42*a* is formed in parallel to the axis of the rotation shaft 12.

Further, the shroud 43 is formed in a circular ring shape with an inside diameter gradually increasing from the axial front end side toward the axial rear end side. The rotation shaft 12 is fitted in its center hole. Moreover, the tip of each of the vanes 42 is joined to the inner peripheral surface of the shroud 43. In other words, the shroud 43 covers the vanes 42 from radially outside so as to connect the tips of the vanes 42 in the circumferential direction.

Thus, at each closed impeller 14, a plurality of spaces surrounded by the outer peripheral surface of the hub 41, the side surfaces of the vanes 42, and the inner peripheral surface of the shroud 43 are formed at equal intervals in the circumferential direction. In other words, these spaces serve as a compression flow channel 44 in which the fluid G taken in is compressed, and are disposed in a radial manner about the rotation shaft 12 and formed to gradually curve outward in the radial direction as extending from the axial front end side toward the axial rear end side. Moreover, the above-described rear edge 42*a* of each vane 42 forms the outlet of the compression flow channel 44.

Thus, the closed impeller 14 can eject the fluid G taken into the compression flow channel 44 outward in the radial direction from that outlet by using a centrifugal force generated by rotating along with the rotation shaft 12. Here, the fluid G taken into the closed impeller 14 is raised in pressure as it passes through the compression flow channel 44.

As described above, the open impellers 13 do not include the shroud 43 and are accordingly lighter in weight than the closed impellers 14. Thus, using both open impellers 13 and closed impellers 14, one or more embodiments of the centrifugal compressor 1 have a smaller total impeller weight than that of a centrifugal compressor in which all impellers are closed impellers 14. Hence, a weight reduction is achieved.

Meanwhile, at each of intermediate portions of the flow channel 20, a diffuser flow channel 24 and a return flow channel 25 as constituent portions of the flow channel 20 are formed in this order along the fluid flow direction.

The diffuser flow channel 24 is a ring-shaped flow channel disposed radially outward (downstream side in the fluid flow direction) of an impeller 13, 14 and extending in the radial direction. Specifically, the annular inlet of the diffuser flow channel 24 faces the outlet of the compression flow channel 34, 44 of the impeller 13, 14 in the radial direction. Thus, the diffuser flow channel 24 can take in the fluid G compressed at the compression flow channel 34, 44 of the impeller 13, 14 and then cause it to flow outward in the radial direction. Here, the fluid G taken into the diffuser flow channel 24 is raised in pressure while being decelerated as it passes through the diffuser flow channel 24.

Also, the return flow channel 25 is a ring-shaped flow channel with a longitudinal cross section extending in the radial direction in a U-shape and allows the annular outlet of the diffuser flow channel 24 located immediately before the return flow channel 25 in the fluid flow direction to communicate with the inlet of the compression flow channel 34, 44 of the impeller 13, 14 located immediately after the return flow channel 25 in the fluid flow direction. Thus, the return flow channel 25 can turn the fluid G caused to flow outward in the radial direction by the diffuser flow channel 24 back toward the inner side in the radial direction and then flow toward the impeller 13, 14 at the subsequent stage.

According to one or more embodiments, when the centrifugal compressor 1 starts being operated, the rotation shaft 12 rotates and the impellers 13, 14 also rotate along with this rotation shaft 12. As a result, the fluid G sucked in from the suction port 21 is taken into the compression flow channel 34 of the open impeller 13 at the first stage, thereby being compressed, and is then discharged from inside this compression flow channel 34.

Thereafter, the fluid G discharged from the compression flow channel 34 is taken into the diffuser flow channel 24, thereby being decelerated and straightened, and then discharged from inside this diffuser flow channel 24. Then, the fluid G discharged from the diffuser flow channel 24 is delivered into the compression flow channel 34 of the open impeller 13 at the second stage through the return flow channel 25.

Subsequently, a compressing action as described above is repeated on the fluid G by the open impeller 13 at the second stage to the closed impeller 14 at the sixth stage. Finally, the fluid G discharged from the compression flow channel 44 of the closed impeller 14 at the sixth stage is discharged to the outside of the compressor through the discharge port 22.

According to one or more embodiments, by causing the fluid G to pass through the centrifugal compressor 1, the fluid G can be compressed in a stepwise manner by the plurality of impellers 13, 14. Accordingly, a high compression ratio can be obtained for the fluid G.

According to one or more embodiments, as described above, in the single-shaft multi-stage the centrifugal compressor 1, the final compression ratio of the fluid G at discharge can be high as a result of compressing the fluid G in a stepwise manner from the open impeller 13 at the first stage (frontmost stage) to the closed impeller 14 at the sixth stage (rearmost stage). In the case where the fluid G is compressed in a stepwise manner as above, the volumetric flow rate of the fluid G accordingly becomes lower and lower after the impeller 13, 14 at each stage. Correspondingly, in the single-shaft multi-stage the centrifugal compressor 1 according to one or more embodiments of the invention, the impeller profile (vane profile) is varied for each stage. Specifically, flow rate coefficients $\phi$ of the impellers 13, 14 are set to be smaller and smaller the farther rearward they are disposed.

Note that each flow rate coefficient $\phi$ is expressed by the following equation.

$$\phi = Q/[(\pi/4)\times D^2\times U]$$

where Q is the volumetric flow rate [$m^3/s$], D is the impeller diameter [m], and U is the impeller circumferential speed [the circumferential speed of the outermost peripheral portion of the impeller] [m/s].

Also, in the case where the rear edge of each vane of the impeller is inclined, the average of a rear-edge front end diameter D1 and a rear-edge rear end diameter D2 is used as the impeller diameter D.

Further, the impeller circumferential speed U can also be expressed as [n×D×N/60], where N is the number of revolutions of the impeller (the number of revolutions of the rotation shaft).

To this end, the centrifugal compressor 1 according to one or more embodiments of the present invention is such that the farther rearward the impeller 13, 14 is disposed, the smaller the flow channel cross-sectional areas of the compression flow channel 34 of the impeller 13 at predetermined positions in the fluid flow direction (e.g. the flow channel cross-sectional areas of the inlet and the outlet) and the smaller the flow channel cross-sectional areas of the compression flow channel 44 of the impeller 14 at predetermined positions in the fluid flow direction (e.g. the flow channel cross-sectional areas of the inlet and the outlet). In this way, the flow rate coefficients $\phi$ of the impellers 13, 14 are set to be smaller and smaller toward the rearmost stage from the frontmost stage. In other words, the compression flow channels 34, 44 of the impellers 13, 14 are formed to be narrower and narrower the farther rearward they are disposed.

Specifically, at the open impellers 13 at the first to third stages on the front stage side (upstream side), the volumetric flow rate of the fluid G is relatively high and therefore the flow channel cross-sectional areas of their compression flow channels 34 are set so as to obtain large flow rate coefficients $\phi$. For example, the flow rate coefficients $\phi$ of the open impellers 13 at the first to third stages are set to gradually decrease within the range of 0.1 to 0.2 ($\phi$=0.1 to 0.2).

Also, each of the open impellers 13, which have large flow rate coefficients, take in a large amount of fluid G flowing thereinto from the axial front end side. Accordingly, when the fluid G taken into the compression flow channel 34 is ejected using a centrifugal force on the open impeller 13, that fluid G is not ejected outward in the radial direction from the outlet of the compression flow channel 34 but is ejected obliquely rearward from the outlet of the compression flow channel 34 since the speed of the fluid G toward the axial rear end side is high.

Specifically, the open impellers 13 at the first to third stages are such that the farther rearward the open impeller 13 is disposed, the lower the volumetric flow rate of the fluid G is and the lower the speed of the fluid G ejected from that open impeller 13 toward the axial rear end side. Accordingly, an ejection angle $\beta$ of the fluid G with respect to the axis of the rotation shaft 12 becomes larger and larger.

Correspondingly, the rear edge 32*a* of each vane 32, which form the outlet of a compression flow channel 34, is inclined to be closer to the inner side in the radial direction as extending from the axial front end side toward the axial rear end side. Inclination angles $\alpha$ of the rear edges 32*a* of the open impellers 13 at the first to third stages with respect to the axis of the rotation shaft 12 are set to be smaller and smaller the farther rearward they are disposed. In other words, the inclination angle $\alpha$ of each rear edge 32*a* is set according to the ejection angle $\beta$ of the fluid G and becomes smaller and smaller as the ejection angle $\beta$ becomes larger and larger.

In this way, the extension direction of each rear edge 32*a* and the ejection direction of the fluid G ejected from the corresponding compression flow channel 34 can be perpendicular to each other, thereby making it possible to prevent disturbance of the flow of the fluid G. This allows efficient compression of the fluid G.

On the other hand, at the closed impellers 14 at the fourth to sixth stages on the rear stage side (downstream side), the volumetric flow rate of the fluid G is lower than at the open impellers 13 on the front stage side, and therefore the flow channel cross-sectional areas of their compression flow channels 44 are set so as to obtain small flow rate coefficients $\phi$. For example, the flow rate coefficients $\phi$ of the closed impellers 14 at the fourth to sixth stages are set to gradually decrease within the range of 0.03 and smaller ($\phi \leq 0.03$).

Also, each of the closed impellers 14, which have small flow rate coefficients, take in a small amount of fluid G flowing thereinto from the axial front end side. Accordingly, when the fluid G taken into the compression flow channel 44 is ejected using a centrifugal force on the closed impeller 14, that fluid G is ejected outward in the radial direction from the outlet of the compression flow channel 44 since the speed of the fluid G toward the axial rear end side is low.

Correspondingly, the rear edges 42*a* of the vanes 42, which form the outlets of the compression flow channels 44, are formed in parallel to the axis of the rotation shaft 12. In other words, at the impellers 14 at the fourth to sixth stages, the inclination angles of their rear edges 42*a* with respect to the axis of the rotation shaft 12 are set at 0°.

In this way, the extension direction of each rear edge 42*a* and the ejection direction of the fluid G ejected from the corresponding compression flow channel 44 can be perpendicular to each other, thereby making it possible to prevent disturbance of the flow of the fluid G. This allows efficient compression of the fluid G.

In the above centrifugal compressor 1 according to one or more embodiments, the open impellers 13 are disposed on the front stage side (three stages on the front side), on which the volumetric flow rate of the fluid G is relatively high, while the closed impellers 14 are disposed on the rear stage side (three stages on the rear side), on which the volumetric flow rate of the fluid G is relatively low. Note, however, that the total number of impeller stages, the numbers of stages with impellers 13, 14, and the order of installation of the impellers 13, 14 are not limited to the above configuration.

Specifically, in the case of using both open impellers 13 and closed impellers 14, the open impellers 13 may be impellers at stages at which the volumetric flow rate of the fluid G is high, while the closed impellers 14 may be impellers at stages at which the volumetric flow rate of the fluid G is low. Here, since the open impellers 13 do not include a shroud, fluid leakage occurs between them and the wall surface 23. Thus, if the open impellers 13 are the impellers at the stages at which the volumetric flow rate of the fluid G is low, the leakage of the fluid G at the low flow rate will greatly affect the compression efficiency. To avoid this, the closed impellers 14, which include the shroud 43, are used as the impellers at the stages at which the volumetric flow rate of the fluid G is low, instead of the open impellers 13, which do not include a shroud.

To this end, an open impeller 13 may be disposed at least at the frontmost stage, at which the volumetric flow rate is highest, and which is located immediately after the suction port 21 in the fluid flow direction, while a closed impeller 14 may be disposed at least at the rearmost stage, at which the volumetric flow rate is lowest. In doing so, the number of stages with open impellers 13 to be disposed successively from the frontmost stage, located immediately after the suction port 21 in the fluid flow direction, toward the rearmost stage and the number of stages with closed impellers 14 to be disposed successively from the rearmost stage toward the frontmost stage may be set as appropriate according to the amount of the fluid G to be sucked in, the compression ratio of the fluid G at discharge, the impeller profiles (vane profiles), and so on.

Next, a case of applying the impellers 13, 14 to a centrifugal compressor 2 including an intermediate suction port 26, according to one or more embodiments, will be described using FIG. 2.

Figure 2:
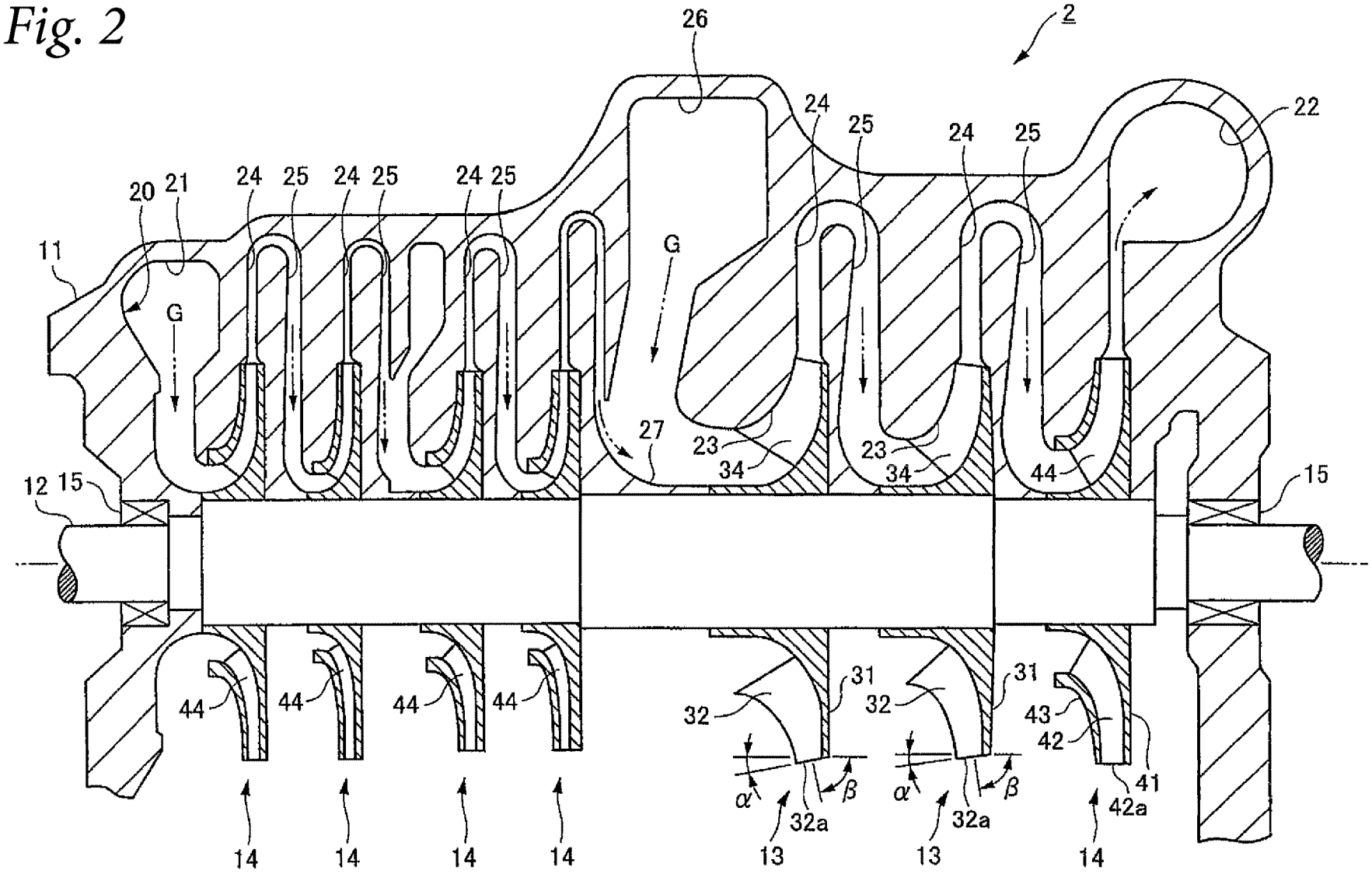
FIG. 2 is a schematic cross-sectional view of a centrifugal compressor according to one or more embodiments of the present invention.

As illustrated in FIG. 2 and in accordance with one or more embodiments, the centrifugal compressor 2 is a single-shaft multi-stage centrifugal compressor provided with a plurality of impellers 13, 14 on a single rotation shaft 12 at a plurality of stages. Moreover, the intermediate suction port 26 communicates with a joining portion 27 of a flow channel 20 which is an intermediate portion in the flow direction. This the intermediate suction port 26 is a port through which to suck a fluid G into the joining portion 27 from outside the compressor.

Further, according to one or more embodiments of centrifugal compressor 2, closed impellers 14 at the first to fourth stages are disposed upstream of the joining portion 27 (intermediate suction port 26) in the fluid flow direction, while an open impeller 13 at the fifth stage, an open impeller 13 at the sixth stage, and a closed impeller 14 at the seventh stage are disposed downstream of the joining portion 27 in the fluid flow direction.

In this way, a fluid G sucked in from a suction port 21 is compressed in a stepwise manner by the closed impellers 14 at the first to fourth stages. Then, the compressed fluid G joins the fluid G sucked in from the intermediate suction port 26 at the joining portion 27. Thereafter, the joined fluid G is compressed in a stepwise manner by the open impeller 13 at the fifth stage, the open impeller 13 at the sixth stage, and the closed impeller 14 at the seventh stage and then discharged from a discharge port 22.

Thus, in one or more embodiments of the centrifugal compressor 2, which includes the intermediate suction port 26, the volumetric flow rate in the flow channel 20 is largest at the joining portion 27. For this reason, an open impeller 13, which has a large flow rate coefficient, is disposed at least at an intermediate stage (fifth stage) located immediately after the intermediate suction port 26, at which the volumetric flow rate is highest, in the fluid flow direction, while a closed impeller 14, which has a small flow rate coefficient, is disposed at least at the rearmost stage (seventh stage), at which the volumetric flow rate is lowest.

Specifically, the open impellers 13 at the fifth and sixth stages are such that the farther rearward the open impeller 13 is disposed, the smaller an inclination angle $\alpha$ of its rear edges 32*a* becomes. On the other hand, the closed impeller 14 at the seventh stage is such that the inclination angle of its rear edges 42*a* is set at 0°.

Thus, in the centrifugal compressors 1, 2 according to one or more embodiments of the present invention, both open impellers 13 and closed impellers 14 are used. Since the open impellers 13 do not include a shroud, which is a heavy object, it is possible to accordingly reduce the total impeller weight and increase the number of revolutions. Also, since the number of revolutions can be increased, the compression efficiency per impeller stage can be improved accordingly. Then, the total number of impeller stages can be reduced. Accordingly, it is possible to achieve a reduced size and cost.

Also, in the case of using an open impeller 13, fluid leakage occurs. However, the open impeller 13 is disposed at a stage at which the volumetric flow rate of the fluid G is highest, and which is located immediately after the suction port 21, 26 in the fluid flow direction. Hence, although fluid leakage occurs, its influence on the efficiency of compression of the fluid G can be minimized.

Further, an open impeller 13 can be easily employed at a stage at which the volumetric flow rate is high by inclining the rear edges 32*a* of its vanes 32.

Although the disclosure has been described with respect to only a limited number of embodiments, those skilled in the art, having benefit of this disclosure, will appreciate that various other embodiments may be devised without departing from the scope of the present invention. Accordingly, the scope of the invention should only be limited by the attached claims.

EXPLANATION OF THE REFERENCE NUMERALS

1, 2 centrifugal compressor
11 casing
12 rotation shaft
13 open impeller
14 closed impeller
15 bearing
20 flow channel
21 suction port
22 discharge port
23 wall surface
24 diffuser flow channel
25 return flow channel
26 intermediate suction port
27 joining portion
31 hub
32 vane
32*a* rear edge
34 compression flow channel
41 hub
42 vane
42*a* rear edge
43 shroud
44 compression flow channel
G fluid
α inclination angle
β ejection angle

The invention claimed is:

1. A centrifugal compressor, comprising:

a plurality of impellers that rotate along with a rotation shaft to pump fluid by using centrifugal force are disposed at a plurality of stages along an axial direction to compress, in a stepwise manner, the fluid sucked in from a suction port;

a closed impeller including a plurality of vanes disposed in a radial manner about the rotation shaft with a shroud covering the plurality of vanes from radially outside; and an open impeller including a second plurality of vanes without a shroud, wherein the closed impeller is disposed at a rearmost stage in a fluid flow direction, the open impeller is disposed at a stage located immediately after the suction port in the fluid flow direction, rear edges of the second plurality of vanes of the open impeller are inclined in a radial direction toward the rotation shaft, on the rear edges, an axial rear end side is closer to the rotation shaft than an axial front end side, and an inclination angle of the rear edges with respect to an axis of the rotation shaft is inversely proportional to the relative distance of the open impeller along the rotation shaft in a fluid flow direction.

* * * * *